US008390603B2

(12) United States Patent
Yi

(10) Patent No.: US 8,390,603 B2
(45) Date of Patent: Mar. 5, 2013

(54) METHOD FOR DRIVING A FLAT PANEL DISPLAY

(75) Inventor: Chien-Yu Yi, Taoyuan (TW)

(73) Assignee: AU Optronics Corporation, Hsinchu (TW)

( * ) Notice: Subject to any disclaimer, the term of this patent is extended or adjusted under 35 U.S.C. 154(b) by 1464 days.

(21) Appl. No.: 11/487,264

(22) Filed: Jul. 14, 2006

(65) Prior Publication Data

US 2007/0018929 A1 Jan. 25, 2007

(30) Foreign Application Priority Data

Jul. 19, 2005 (TW) ..... 94124262 A

(51) Int. Cl.
*G09G 3/36* (2006.01)

(52) U.S. Cl. ..... 345/204; 205/206; 205/207; 205/690; 205/694; 205/99

(58) Field of Classification Search ..... 345/98, 345/204
See application file for complete search history.

(56) References Cited

U.S. PATENT DOCUMENTS

| | | | | |
|---|---|---|---|---|
| 6,417,830 | B1 * | 7/2002 | Byeon, II | 345/99 |
| 6,924,784 | B1 * | 8/2005 | Yeo et al. | 345/98 |
| 7,042,426 | B2 * | 5/2006 | Shin | 345/76 |
| 7,173,600 | B2 * | 2/2007 | Kodate et al. | 345/103 |
| 2004/0104908 | A1 * | 6/2004 | Toyozawa et al. | 345/211 |

OTHER PUBLICATIONS

Craig Zajaz, "Using Smart Charge Sharing to Reduce Power and Boost Column Driver Performance" National Semiconductor Application Note AN-1235, May 2002, pp. 1-4.

* cited by examiner

*Primary Examiner* — Grant Sitta
(74) *Attorney, Agent, or Firm* — J.C. Patents

(57) ABSTRACT

A method for driving a flat panel display is provided. The flat panel display has n scan lines, wherein n is a positive integer. Each of the scan lines is coupled to a plurality of pixels. The driving method according to the invention includes the steps as follows: when pixels coupled to a $k^{th}$ scan line are enabled, pixels coupled to the scan lines from the first to $k-1^{th}$ are disabled and pixels coupled to at least a part of scan lines from $k+1^{th}$ to $n^{th}$ are enabled, thus pre-charging the enabled pixels of scan lines from $k+1^{th}$ to $n^{th}$ is performed thereby, wherein k is a positive integer.

5 Claims, 7 Drawing Sheets

FIRST FRAME
(ODD FRAME)

SECOND FRAM
(EVEN FRAME)
COLUMN INVERSION

FIRST FRAME
(ODD FRAME)

SECOND FRAM
(EVEN FRAME)
DOT INVERSION

METHOD FOR DRIVING A FLAT PANEL DISPLAY

CROSS-REFERENCE TO RELATED APPLICATION

This application claims the priority benefit of Taiwan application serial no. 94124262, filed on Jul. 19, 2005. All disclosure of the Taiwan application is incorporated herein by reference.

BACKGROUND OF THE INVENTION

1. Field of the Invention

The present invention relates to method for driving a flat panel displays, and particularly to a method for driving a flat panel display for reducing power consumption of a source driver by modified scan signals, and therefore for reducing the system power consumption.

2. Description of Related Art

In order to catch up with the modern lifestyle, video and image devices are becoming slimmer and lighter. Despite of advantages it may have, a conventional cathode-ray tube (CRT) display not only is large in bulk that occupies too much room because of its intrinsic structure of the electronic cavity, but also radiates rays which may hurt human eyes. Therefore, accompanying the development of optoelectronic technology and semi-conductor processing technology, flat panel displays including liquid crystal display (LCD), organic light-emitting diode (OLED) display and plasma display panel (PDP) are gradually becoming a mainstream in the display market.

Resolutions and refreshing frequencies of flat panel displays are continuously improving. Consequently, refreshing frequencies of scan lines are demanded to be more and more rapid, which contradicts the designs for power saving by system engineers. As a result, a technology for eliminating the contradiction therebetween called "smart charge sharing" technology is developed thereby.

FIGS. 1A and 1B are schematic diagrams of a conventional charge sharing technology provided by Dr. Craig Zajac of the US National Semiconductor Incorporation. Referring to FIG. 1A, first, a flat panel display 100 includes a source driver 110 and a pixel array 130. The pixel array 130 includes a plurality of data lines DL0 through DLm electrically connected to the source driver 110.

The source driver 110 includes a plurality of output amplifiers A1 through Am. Each of the output terminals of the amplifiers is respectively connected to a corresponding data line. The source driver 110 further includes a plurality of switches SW1 through SWm−1 for connecting adjacent two data lines. For example, a switch SW1 is adapted for connecting the adjacent data lines DL0 and DL1. As shown in FIG. 1A, each data line is taken as a sum of loads of resistance and capacitance of a corresponding output amplifier.

Before the source driver 110 driving the pixel array 130, voltages of each pair of the adjacent data lines are respectively higher or lower than a common voltage. Meanwhile, all of the switches SW1 through SWm−1 are at turn-off status. At the instance that the source driver 110 starts to drive the pixel array 130, all of the switches SW1 through SWm−1 will be switched to turn-on status as shown in FIG. 1B. At this certain instance, all amplifiers A1 through Am are at disable status, which is called Hi-Z mode during which the output amplifiers A1~Am without current consumption. However, as the switches SW1 through SWm−1 are at turn-on status, there will be a current flowing from a data line having a voltage higher than the common voltage to a data line having a voltage lower than the common voltage, the path of which is as illustrated of the arrowheads in FIG. 1B. Thus, charges can be neutralized therein. After experiencing a Hi-Z mode, the switches SW1 through SWm−1 will go back to the turn-off status, while the source driver 110 can the drive pixel array 130 as usual.

In summary, the principle of the charge sharing technology is to reallocate energy (charges) stored in the data lines and whereby to drive the scan lines to a half of the final value without power consumption. Such technology is enough for those small flat panel displays taking little loads and providing a lower resolution. Unfortunately, whenever an overall slew rate of the source driver 110 slows down, an efficiency of the source driver 110 will drop down accordingly. Therefore, such a source driver can not satisfy the requirements of the new generation flat panel displays which demand higher resolution, higher load and larger size.

SUMMARY OF THE INVENTION

Therefore, an object of the invention is to provide a method for driving a flat panel display for efficiently reducing power consumption of large-sized flat panel displays.

According to an aspect of the invention, the present invention provides a method for driving a flat panel display suitable for driving a flat panel display having a pixel array. The pixel array has n scan lines, wherein n is a positive integer. Each of the scan lines is coupled to a plurality of pixels. The method according to the invention includes as follows: first of all, the flat panel display generates a scan signal to enable a plurality of pixels coupled to a $k^{th}$ scan line, wherein k is a positive integer. According to the invention, when k=1, a plurality of first pixels coupled to at least one part of scan lines from the second to the $n^{th}$ is enabled; when $1<k<n$, a plurality of second pixels coupled to the scan lines from the first to the $k-1^{th}$ is disabled and a plurality of third pixels coupled to at least one part of scan lines from the $k+1^{th}$ to the $n^{th}$ is enabled; when k=n, a plurality of fourth pixels coupled to the scan lines from the first to the $n-1^{th}$ is disabled; then the flat panel display generates data signals to the pixel array.

According to another aspect of the invention, the present invention provides a method for driving a flat panel display, wherein the flat panel display includes a plurality of pixels disposed in an array. The method provided herein is featured as that when a row of pixels among the array of pixels are enabled, all pixels thereafter are enabled thereby.

As above-mentioned, when pixels of the $k^{th}$ scan line are enabled, some pixels of a part of the rest scan lines are also enabled. Therefore, as driving pixels coupled to the $k^{th}$ scan line, data signals will also pre-charge the other enabled pixels at the same time. As a result, it consumes less current when driving the pre-charged pixels of the rest scan lines.

BRIEF DESCRIPTION OF THE DRAWINGS

The features of the invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DESCRIPTION OF THE EMBODIMENTS

Figure 1A:
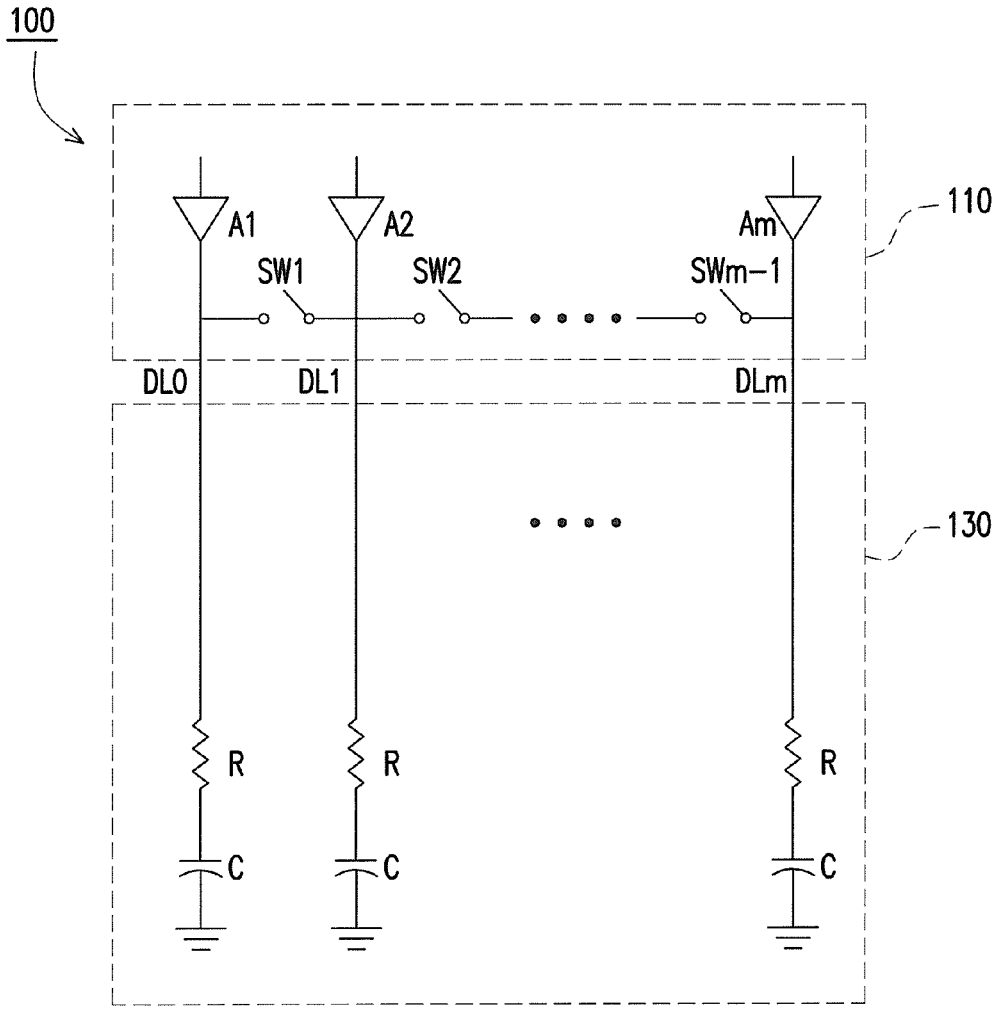
FIG. 1A (RELATED ART)
FIGS. 1A and 1B are schematic diagrams of a conventional charge sharing technology.
Figure 1B:
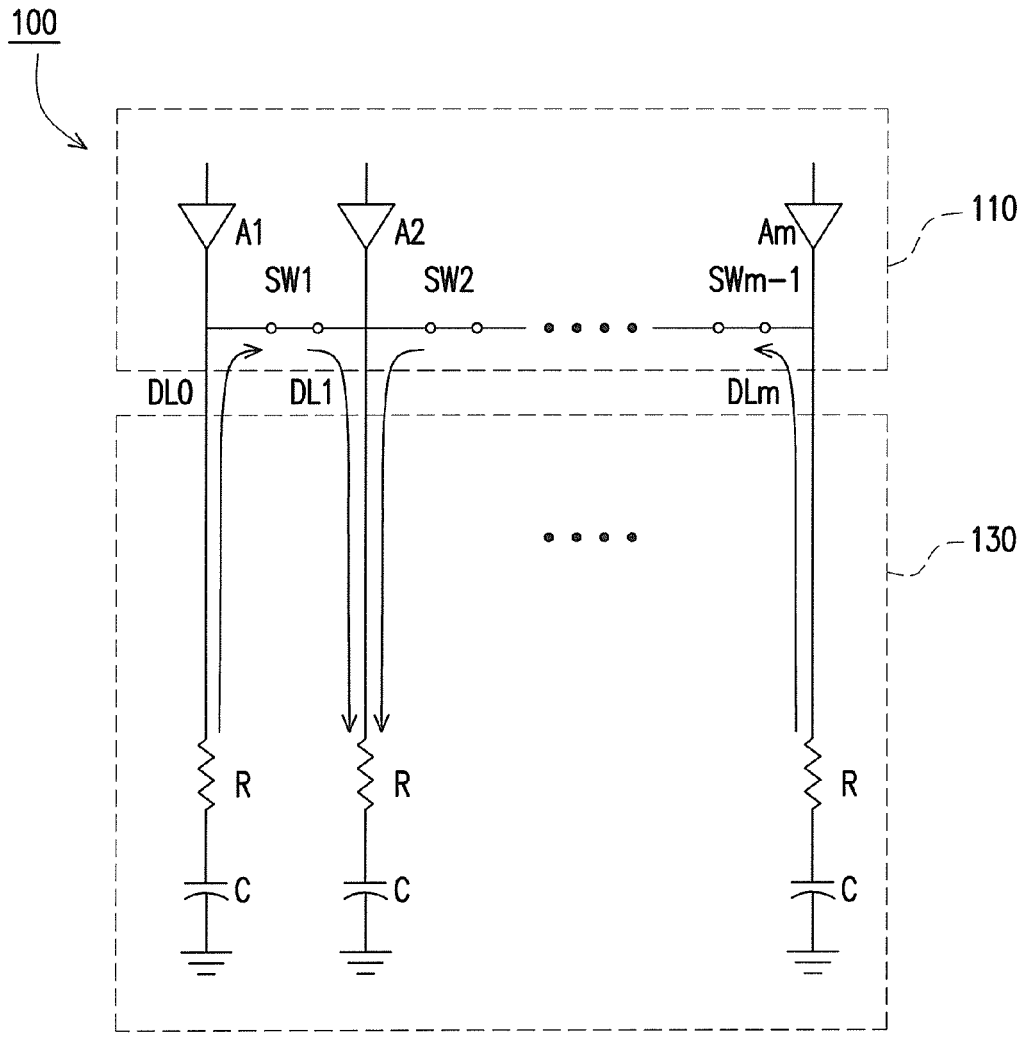
FIG. 1B (RELATED ART)
Figure 2:
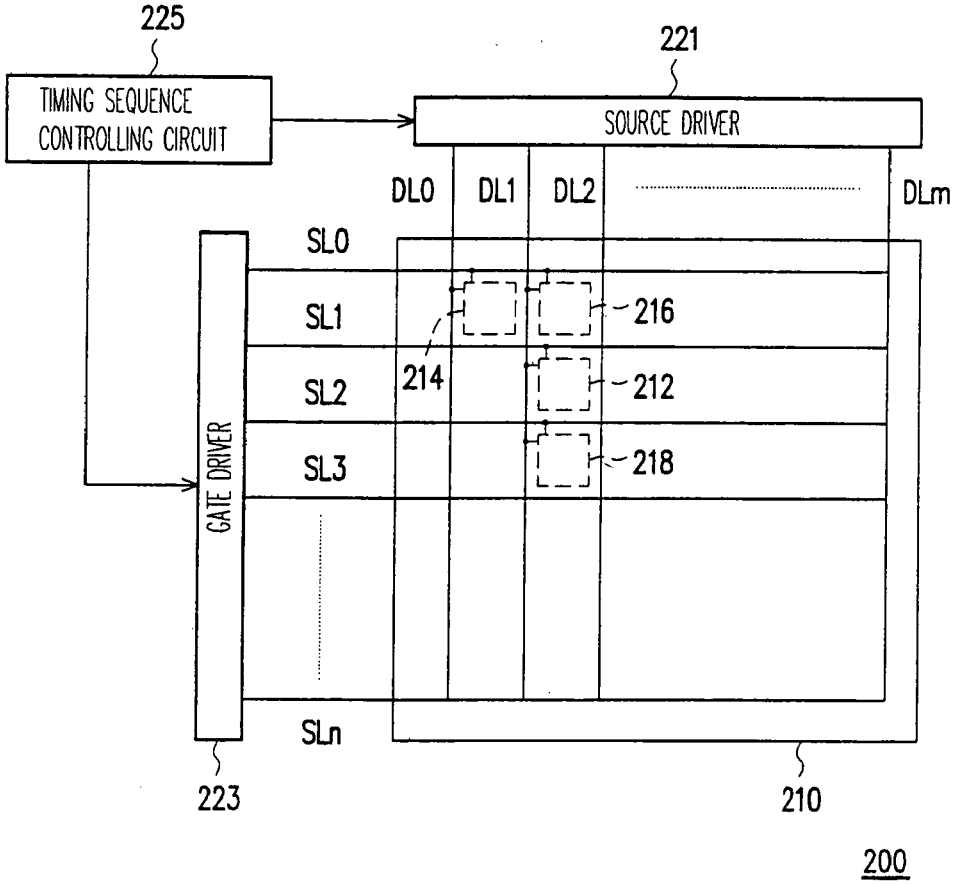
FIG. 2 is a block diagram for a circuit of a flat panel display according to an embodiment of the invention.

FIG. 2 is a block diagram for a circuit of a flat panel display 200 according to an embodiment of the invention. Referring to FIG. 2, the flat panel display 200 includes a pixel array 210. The pixel array 210 is coupled to a gate driver 223 via a, plurality of scan lines SL0 through SLn and coupled to a source driver 221 via a plurality of data lines DL0 through DLm, wherein n and m are positive integers greater than 1. The flat panel display 200 further includes a timing sequence control circuit 225 which controls the source driver 221 and the gate driver 223.

In the pixel array 210, the data lines DL0 through DLm are parallel with each other taking along a first orientation, and the scan lines SL1 through SLn are parallel with each other taking along a second orientation. The first orientation and the second orientation can be perpendicular with each other. The data lines DL0 through DLm and the scan lines SL1 through SLn are alternately distributed without being in touch with each other.

A pixel is disposed in a domain defined by a data line and a scan line. For example, a pixel 212 is disposed in a domain defined by data lines DL1, DL2 and scan lines SL1 and SL2. Each of such pixels includes a gate terminal and a source terminal, respectively connected to the corresponding scan line and data line. For example, the gate terminal of the pixel 212 is coupled to the corresponding scan line SL1, while the source terminal of the pixel 212 is coupled to the corresponding data line DL1.

Figure 3:
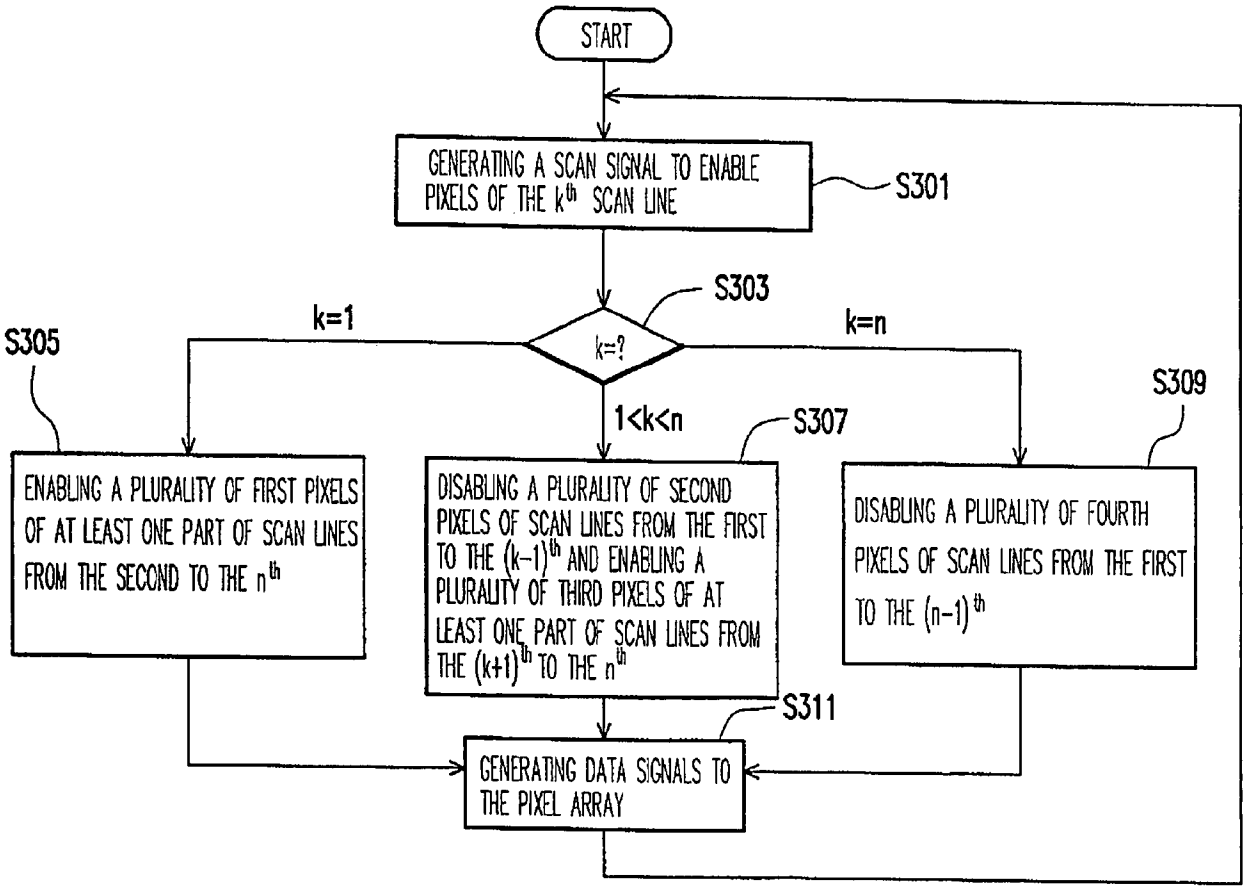
FIG. 3 is a flow chart illustrating a method for driving a flat panel display according to an embodiment of the invention.

FIG. 3 is a flow chart illustrating a method for driving a flat panel display according to an embodiment of the invention. Referring FIG. 2 and FIG. 3, when the timing sequence controlling circuit 225 controls the gate driver 223 as described in step S301 to generate a scan signal for enabling pixels of a $k^{th}$ scan line, the value of k is judged at step S303. If k=1, the gate driver 223 is to enable pixels coupled to the first scan line SL0 such as pixels 214 and 216 etc., and the gate driver 223, as described in step S305, enables a plurality of the first pixels coupled to at least one part among the scan lines from the second SL1 to the $n^{th}$ SLn.

If $1<k<n$ and n is a positive integer, the gate driver 223, as described in step S307, disables a plurality of second pixels coupled to scan lines from the first to the $k-1^{th}$ and enable a plurality of third pixels coupled to one part of scan lines from the $k+1^{th}$ to the $n^{th}$. For example, when k=3, the gate driver 223 enables pixels (such as pixel 218) coupled to the third scan line SL2, it also disables the second pixels coupled to the first SL0 and the second SL1 scan lines and enables the third pixels of one part of scan lines from the fourth SL3 to the $n^{th}$ SLn.

In other words, if k=n, the gate driver 223, as described in step S309, enables the pixels of the last scan line, and it disables a plurality of fourth pixels coupled to the scan lines from the first to the $n-1^{th}$. After the gate driver 223 has completed any of the steps S305, S307 and S309, the timing sequence controlling circuit 225, as described in step S311, controls the source driver 221 to generate data signals and transmit the data signals to the pixel array 210 via the data lines DL0 through DLm sequentially.

When pixels coupled to the $k^{th}$ scan line is enabled according to the invention, pixels of some other scan lines are enabled, too. Therefore, when the source driver 221 is generating data signals for driving pixels of the $k^{th}$ scan line, the other enabled pixels are being pre-charged at the same time. As a result, pixels of each scan line are pre-charged before being driven. Therefore, a comparative lower current can drive such pre-charged pixels. Thus, current consumed by driving pixels as well as the system power consumption can be reduced.

LCD of flat panel displays has a characteristic that liquid crystal molecules cannot be fixed all the times under a certain voltage. Otherwise, even after the certain voltage is removed, the characteristic of the liquid crystal molecules may be damaged and lose their abilities to turn in accordance with the electric field variation. Therefore, after a certain time, even though the displayed image is the same, the voltages applied to the liquid crystal molecules have to be changed for avoiding liquid crystal features being damaged. Among the driving methods for LCD panels, the method for polarity inversion is relatively important.

For example, if an LCD has a resolution of 1024×768, it has pixels of 1024 columns (data lines) by 768 rows (scan lines), and each of the pixels has three sub-pixels of red color, green color and blue color. The method for polarity inversion of each sub-pixel of each pixel is generally as follows: voltage differences applied to the liquid crystals is divided into a positive voltage difference and a negative voltage difference; the liquid crystals exhibit respectively positive polarity and negative polarity after being applied voltages.

Figure 4A:
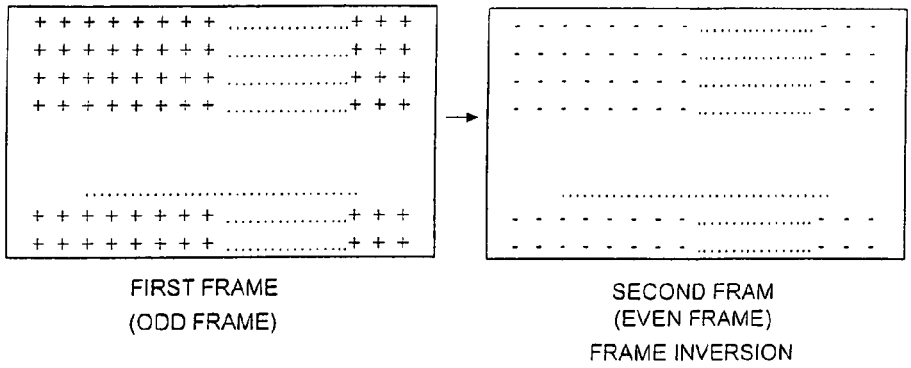
FIGS. 4A through 4D are diagrams illustrating a polarity inversion of sub-pixels of an LCD according to an embodiment of the invention.
Figure 4B:
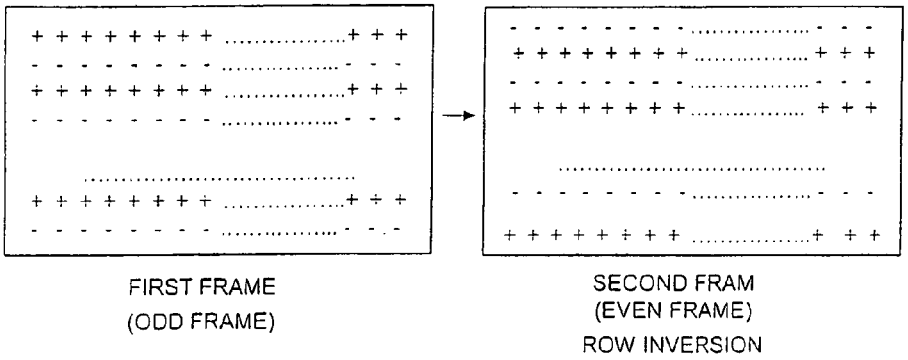
Figure 4C:
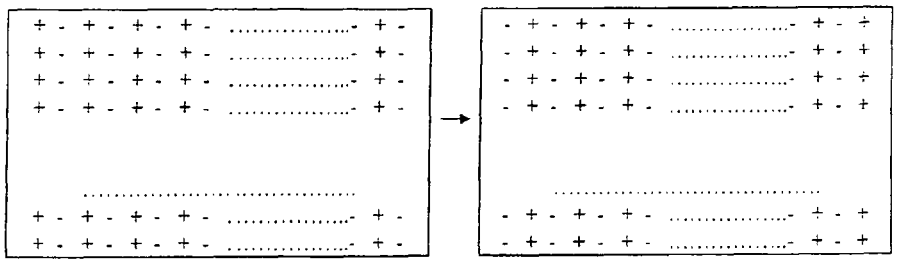
Figure 4D:
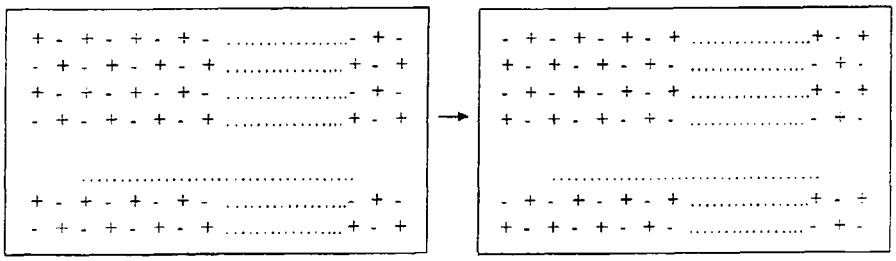

FIGS. 4A through 4D are diagrams illustrating a polarity inversion of sub-pixels of an LCD according to an embodiment of the invention. Generally, methods for polarity inversion include frame inversion as illustrated in FIG. 4A, row inversion as illustrated in FIG. 4B, column inversion as illustrated in FIG. 4C and dot inversion as illustrated in FIG. 4D. If the present invention is employed in an LCD having polarity inversion operation, as above-described, when pixels of the $k^{th}$ scan line are enabled, among pixels of the scan lines from the $k+1^{th}$ to the $n^{th}$, those pixels having the same polarity with pixels of the $k^{th}$ scan line can be selected to be enabled. For example, when the pixels of the first scan line are enabled, a plurality of redundant scan signals is generated to enable a plurality of pixels having the same polarity with the pixels coupled to the first scan line, or to enable a plurality of pixels coupled to odd scan lines from the second scan line to the $n^{th}$ scan line. In addition, when the pixels of the $k^{th}$ scan line are enabled, the redundant scan signals are used to enable a plurality of pixels having the same polarity with the second pixels coupled to a $k^{th}$ scan line, or to enable a plurality ninth coupled to odd scan lines from the $k+1^{th}$ scan line to the $n^{th}$ scan line when k is an odd number.

For example, if a 1024×768 LCD adopts a row inversion method, when pixels of the first scan line are enabled, then among the scan lines from the second to the $768^{th}$, the pixels coupled to the odd scan lines will be enabled. That is, for a row inversion type LCD, when pixels of the $k^{th}$ scan line are enabled, and if k is an odd number, the pixels of odd scan lines from the $k+1^{th}$ to the last are enabled; and if k is an even number, the pixels of even scan lines from the $k+1^{th}$ to the last are enabled.

Figure 5:
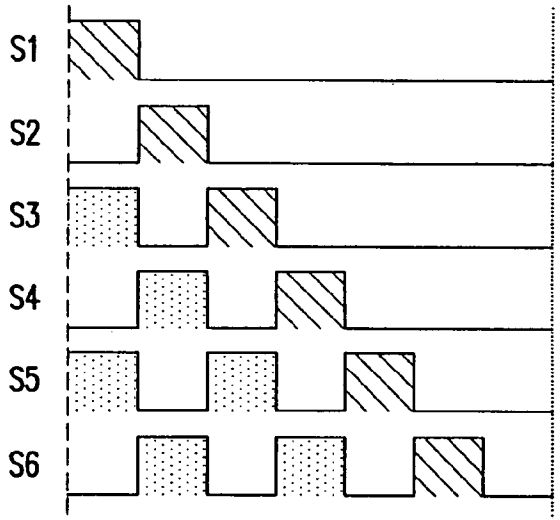
FIG. 5 is a timing sequence diagram of scan signals according to an embodiment of the invention.

FIG. 5 is a timing sequence diagram of scan signals according to an embodiment of the invention. Referring to FIG. 5, the timing sequence of scan signals is adapted for a row inversion type LCD. When a scan signal S1 for enabling the pixels of the first scan line are enabled, redundant scan signals will occur at odd scan lines after the second scan line, for example, S3 and S5. Herein, the redundant scan signals are adapted for enabling and pre-charging pixels of the corresponding scan lines. Similarly, when a scan signal S2 for enabling pixels of the second scan line is enabled, redundant scan signals will occur at even scan lines after the third scan line, for example, S4 and S6. When a scan signal S3 for enabling pixels of the third scan line is enabled, the scan signals S1 and S2 for enabling pixels of the first scan line and the second scan line are disabled, and redundant scan signals will occur at odd scan lines after the fourth scan line for pre-charging pixels thereof.

According to other embodiments, when pixels of the $k^{th}$ scan line are enabled, rather than all pixels of the odd scan lines or even scan lines among the scan lines from the $k+1^{th}$ to the last, only pixels of a predetermined quantity of the odd scan lines or even scan lines are to be enabled. Consequently, the present invention is adapted for flat panel displays in any size, without lack of driving ability.

Although the foregoing embodiments take row inversion type LCDs as examples for illustration purpose, those skilled in the art may apply or introduce the spirit of the invention to LCDs or flat panel displays of other types.

It should be noted that specific embodiments of, and examples for, the invention are described herein for illustrative purposes, various equivalent modifications are possible within the scope of the invention, as those skilled in the relevant art will recognize that modifications and adaptations of the above-described preferred embodiments of the present invention may be made to meet particular requirements. This disclosure is intended to exemplify the invention without limiting its scope. All modifications that incorporate the invention disclosed in the preferred embodiment are to be construed as coming within the scope of the appended claims or the range of equivalents to which the claims are entitled.

What is claimed is:

1. A method for driving a flat panel display, adapted for driving the flat panel display with a pixel array having n scan lines, wherein n is a positive integer and each of the scan lines is coupled to a plurality of pixels, the method comprising the steps of:

generating a scan signal to enable pixels coupled to a kth scan line, wherein k is a positive integer;

enabling a plurality of first pixels coupled to all of the odd scan lines from a second scan line to a nth scan line, when k=1, wherein the first pixels have the same polarity with the pixels coupled to the kth scan line;

disabling a plurality of second pixels coupled to the scan lines from a first scan line to a k−1th scan line, and enabling a plurality of third pixels coupled to all of the odd scan lines at from a k+th scan line to a nth scan line, when $1<k<n$ and k is an odd number;

disabling a plurality of fourth pixels coupled to the scan lines from the first scan line to a n−1th scan line, when k=n; and generating a data signal to the pixel array.

2. The method for driving a flat panel display according to claim 1, wherein the step of enabling the first pixels comprises a step of generating a plurality of redundant scan signals to all of the odd scan lines coupled to the first pixels.

3. The method for driving a flat panel display according to claim 1, wherein when the step of enabling the third pixels comprises a step of enabling a plurality of fifth pixels coupled to the scan lines from the $k+1^{th}$ scan line to the $n^{th}$ scan line having the same polarity as the pixels coupled to the $k^{th}$ scan line.

4. The method for driving a flat panel display according to claim 3, wherein the step of enabling the third pixels comprises a step of enabling a plurality of seventh pixels coupled to even scan lines from the $k+1^{th}$ scan line to the $n^{th}$ scan line or couple to a predetermined number of the even scan lines from the $k+1^{th}$ scan line to the $n^{th}$ scan line, when k is an even number.

5. The method for driving a flat panel display according to claim 3, wherein the step of enabling the fifth pixels comprises a step of generating a plurality of redundant scan signals to scan lines coupled to the fifth pixels.

* * * * *